US007422341B2

(12) United States Patent
Henrici et al.

(10) Patent No.: US 7,422,341 B2
(45) Date of Patent: Sep. 9, 2008

(54) OVEN LIGHT

(75) Inventors: Dieter Henrici, Arnsberg (DE); Jorg Harnischmacher, Menden (DE); Hans Wedding, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 11/653,795

(22) Filed: Jan. 16, 2007

(65) Prior Publication Data

US 2007/0165415 A1 Jul. 19, 2007

(30) Foreign Application Priority Data

Jan. 19, 2006 (DE) ..... 10 2006 002 667

(51) Int. Cl.
*F21V 33/00* (2006.01)

(52) U.S. Cl. ..... 362/92; 362/457; 362/649

(58) Field of Classification Search ..... 362/92, 362/362, 363, 368, 374, 375, 443, 446, 455, 362/457, 458, 647, 649, 651
See application file for complete search history.

(56) References Cited

U.S. PATENT DOCUMENTS

| | | | | |
|---|---|---|---|---|
| 4,326,243 A | | 4/1982 | Pistor | |
| 5,744,901 A | * | 4/1998 | Friederichs et al. | 362/649 |
| 6,350,045 B1 | * | 2/2002 | Pearce | 362/363 |
| 7,172,321 B1 | * | 2/2007 | Tseng | 362/374 |
| 2005/0225966 A1 | | 10/2005 | Hartmann | 362/147 |

FOREIGN PATENT DOCUMENTS

| | | |
|---|---|---|
| DE | 2472207 | 3/1979 |
| DE | 34 28 329 | 2/1986 |
| DE | 195 04 405 | 8/1996 |
| EP | 1505351 | 2/2005 |

* cited by examiner

*Primary Examiner*—Y M. Lee
(74) *Attorney, Agent, or Firm*—Andrew Wilford

(57) ABSTRACT

An electrical light has a tubular sheet-metal housing centered generally on an axis and formed with a plurality of angularly spaced, radially inwardly projecting, and radially elastically deflectable spring tongues. A socket in the housing holds a light bulb. A cup-shaped glass lens has a dome formed with a generally cylindrical collar dimensioned to fit into the housing with the dome fitting over a light bulb in the socket. The collar is formed with a plurality of angularly spaced and radially outwardly open L-shaped grooves each fittable with a respective one of the tongues. Each groove has an axially extending and open leg and an angularly extending leg. The angularly extending legs each have an outer flank and an inner flank between the respective outer flank and the dome.

12 Claims, 4 Drawing Sheets

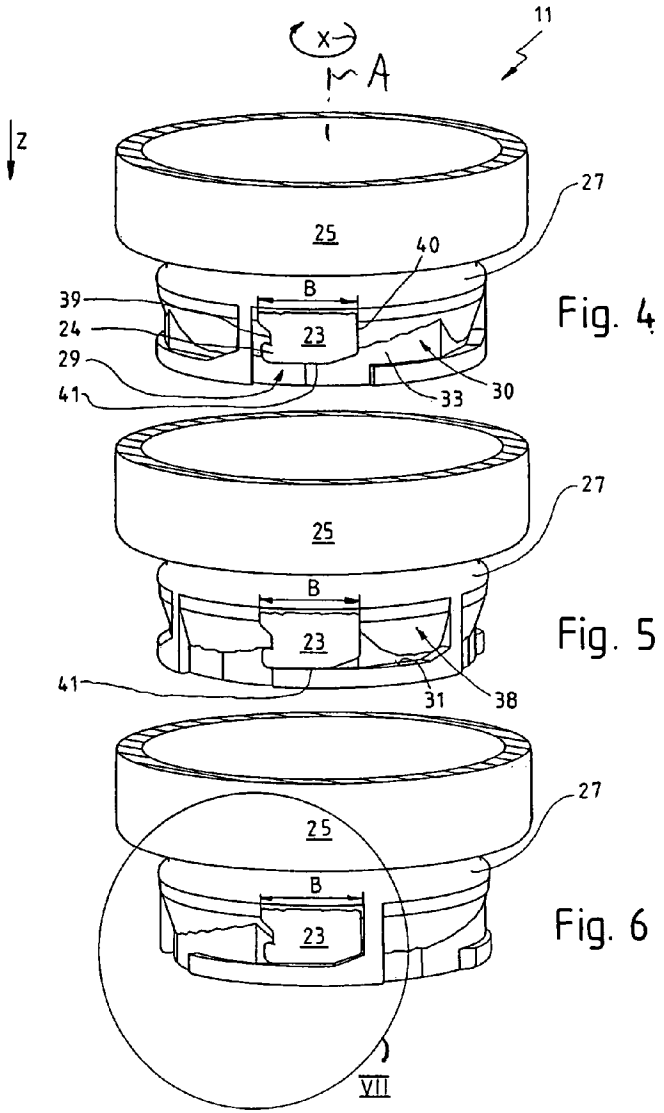
Fig. 4
Fig. 5
Fig. 6
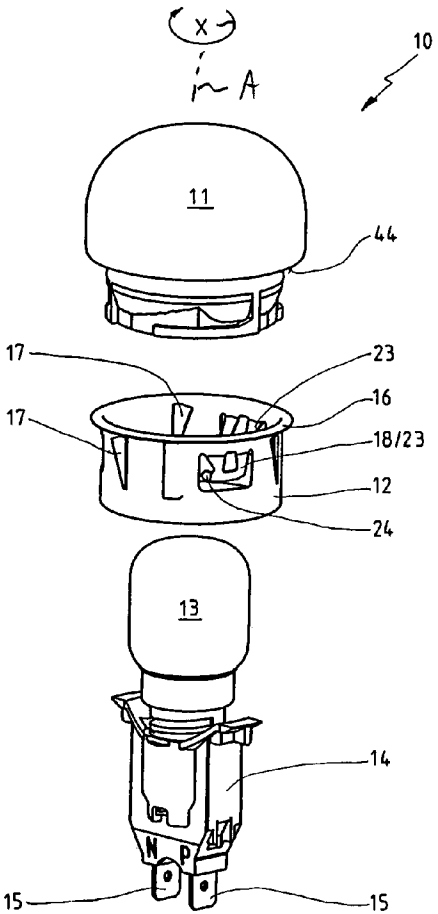
Fig. 1

OVEN LIGHT

FIELD OF THE INVENTION

The present invention relates to an electrical light fixture. More particularly this invention concerns such a fixture intended to be built into a kitchen appliance, for instance into an oven of a stove.

BACKGROUND OF THE INVENTION

A typical such light has a housing made of sheet steel that forms locking members directed inward in the housing for a bayonet-type mount or a screw attachment of a lens fitting over a light bulb or source, and that holds a socket for the light source. The lens has an approximately cup-like dome and a collar defining an opening and fittable into the housing. The collar is has L-shaped angularly distributed grooves formed by axially extending insertion groove legs for the locking members, and angularly extending holding groove legs adjacent thereto by means of which the lens may be fixed in an end position in the housing by performing an inserting-rotating motion. Each angularly extending groove leg has an outer flank on the opening side and by an inner flank on the dome side.

Such electrical lights are well known from the prior art, in particular as oven lights. The housing, which carries electrical connections for the light-bulb socket, is typically positioned and attached in a recess in the wall of an oven. The lens together with its threaded collar is inserted into this typically cup-like seat and is either screwed in or fixed in place in the manner of a bayonet lock, so that the light source in the housing, the connection elements, and the socket for the light source are protected from grease splatters or the like.

For cost reasons it has become customary to manufacture the housing from a stainless steel or surface-treated steel sheet that generally has stamped formations directed toward the interior of the housing that are used as locking sections or threaded sections for securing the lens to the housings, and that are referred to below as locking members. The lens usually has a stop surface, and is screwed into the housing until this stop surface is securely seated on a flanged edge of the housing.

Lenses having a groove on their collar for a bayonet-type mount also typically have a thread-like section in a region of the groove, so that here as well the stop surface may be axially tightened against the flanged edge of the housing by rotation.

To prevent the lens from becoming unscrewed, the threads of the lens have a very shallow pitch so that a certain self-locking of the thread is achieved. The lens is furthermore protected from becoming unscrewed as the result of its tightening torque, as well as the frictional adhesion thus produced between the flanged edge of the housing and the outer flank. A corresponding screw-in oven light is disclosed, for example, in U.S. Pat. No. 4,326,243 and German patent publication 2,921,425.

A common problem with the above-referenced oven lights is that, due to the high temperatures of 300° C., or up to 450° C. for self-cleaning ovens, the stop surface of the lens on the flanged edge of the housing and on the locking or threaded sections may bake on, so that the glass lens may no longer be unscrewed. This effect is intensified, particularly in the region of the flanged edge, by contamination during use of the appliance. In practice, when a defect is present in the light source in the oven light it is often necessary to destroy the lens in order to replace the bulb.

Furthermore, it has been found that not only is removal of the lens for maintenance made more difficult by the lens baking onto the flanged edge of the housing, an additional problem is the tightening torque of the lens that results in a certain stress on the housing, in particular in the region of the locking members. This further promotes the baking of the lens onto the housing. In addition, the inherently circular housing is deformed into a polygon as the result of screwing in the cover, which likewise interferes with the unscrewing motion for the lens.

Proceeding from this problem, DE 195 04 405 discloses an oven light having a small distance between the stop surface and the flanged surface of the housing. For this basically advantageous oven light, however, vapors may penetrate this gap and the installation opening for the oven light provided in the oven chamber, entering the cavity between the chamber and the outer oven wall. Over time, contamination results that may cause operational problems, since it is here that the essential control elements for the oven are located.

OBJECTS OF THE INVENTION

It is therefore an object of the present invention to provide an improved light for a kitchen appliance, typically an oven or a stove.

Another object is the provision of such an improved light for a kitchen appliance, typically an oven or a stove that overcomes the above-given disadvantages, in particular that ensures a good hermetic seal between the lens and the housing, but that is so constructed that baking of the lens onto the housing or deformation of the housing is avoided.

SUMMARY OF THE INVENTION

An electrical light has according to the invention a tubular sheet-metal housing centered generally on an axis and formed with a plurality of angularly spaced, radially inwardly projecting, and radially elastically deflectable spring tongues. A socket in the housing holds a light bulb. A cup-shaped glass lens has a dome formed with a generally cylindrical collar dimensioned to fit into the housing with the dome fitting over a light bulb in the socket. The collar is formed with a plurality of angularly spaced and radially outwardly open L-shaped grooves each fittable with a respective one of the tongues. Each groove has an axially extending and open leg and an angularly extending leg. The angularly extending legs each have an outer flank and an inner flank between the respective outer flank and the dome.

The bayonet-type mount of the lens primarily ensures ease of installation and removal, the pretensioned spring tongues projecting radially inward in the housing ensuring good centering of the lens in the housing. In addition, the elastic force of the spring tongues produces a friction-fit connection between the lens and the housing that is protected from becoming accidentally unscrewed. Lastly, the design of the locking elements as spring tongues prevents polygonal deformation of the inherently circular housing, since the spring tongues may compensate for radial stresses.

In one embodiment, the edge of the spring tongues extending angularly is guided with play by the outer flanks when the lens is secured in the housing.

In a particularly preferred embodiment, a floor of at least one angularly extending groove leg is designed, at least in part, as a radial cam having a raised region that slopes upward or radially outward from the vicinity of the axial groove leg toward an outer periphery of the collar, and having an adjacent surface region that slopes downward or radially inward, in particular in a steep manner, to the floor level and that is used to prevent reverse rotation.

The preferably gradually, upwardly sloping surface region allows a simple and smooth rotational motion of the lens in the housing, the spring tongues being spread outward in the direction of the housing wall, whereas the steeper downwardly sloping surface region provides protection from reverse rotation that effectively prevents the lens from becoming accidentally unscrewed as the result of vibrations during transport, for example. However, by means of the steeply downwardly sloping surface the associated spring tongue may be spread again during an unscrewing motion, the protection from reverse rotation overcome, and the lens removed.

When at least one angularly extending groove leg forms a bearing region for the associated spring tongue that adjoins the downwardly sloping surface region and approximately corresponds to the width of the spring tongue lying in the collar circumferential direction of the lens, the spring tongue rests against the lens essentially free of tension, so that the housing is also essentially free of tension when the lens is installed.

In the end region of the angularly extending groove leg facing away from the axial groove leg, at least one angularly extending groove leg in the electric light may form a stop bevel, which together with another bevel allows axial positioning by means of a corresponding rotational motion. Thus, on the one hand compensation may be made for production tolerances of the lens, and on the other hand the lens for the oven light according to the invention may be screwed slightly farther into the housing, thereby ensuring secure contact of the outer surface of the lens against the flanged edge of the housing.

The radial forces from the spring tongues that act on the downwardly sloping surface region produce an automatic rotational motion in the screw-in direction. This rotational motion, which may be precisely and easily adjusted by means of the pretension of the spring tongues, in conjunction with the axial stop bevel ensures precisely defined and easy contact of the stop surface of the lens against the flanged edge.

It is preferred that at least one angularly extending groove leg has in its end region facing away from the axial groove leg a stop that cooperates with a spring tongue and that limits the rotational motion of the lens. During installation this stop not only determines the end position of the lens, but also limits in a particularly effective manner the maximum tightening torque, and therefore the stresses, when the stop that limits the rotational motion contacts the stop bevel, and the end region of the angularly extending groove leg is formed by the stop. In this manner the lens is effectively prevented from baking onto the housing.

When at least one spring tongue forms a latch tab pointing radially into the interior of the housing, so that only the latch tab contacts the floor of the angularly extending groove leg and the edge of the spring tongue oriented in the circumferential direction of the collar rests against the outer flank, the contact surface between the lens and the spring tongue is limited to a minimum. Large-area baking of the spring tongue onto the lens and the associated difficulties in removal are thus effectively counteracted.

In a further embodiment, at least one spring tongue has a bevel corresponding to the stop bevel of the angularly extending groove leg for axial positioning of the lens. In one particularly preferred embodiment, the bevel is formed by the edge, oriented in the circumferential direction of the collar, of at least one spring tongue.

The stability of the collar is increased by virtue of the greater wall thickness when the dome-side inner flank of at least one angularly extending groove leg is designed, at least in the region of the axial groove leg, as a frustoconical surface from the outer periphery of the collar to the floor of the angularly extending groove leg.

BRIEF DESCRIPTION OF THE DRAWING

The above and other objects, features, and advantages will become more readily apparent from the following description, reference being made to the accompanying drawing in which:

FIG. 1 is a perspective exploded view of the oven light according to the invention;

FIGS. 4, 5, and 6 are detail views showing the lens and housing in three succeeding assembly positions;

SPECIFIC DESCRIPTION

Figure 2:
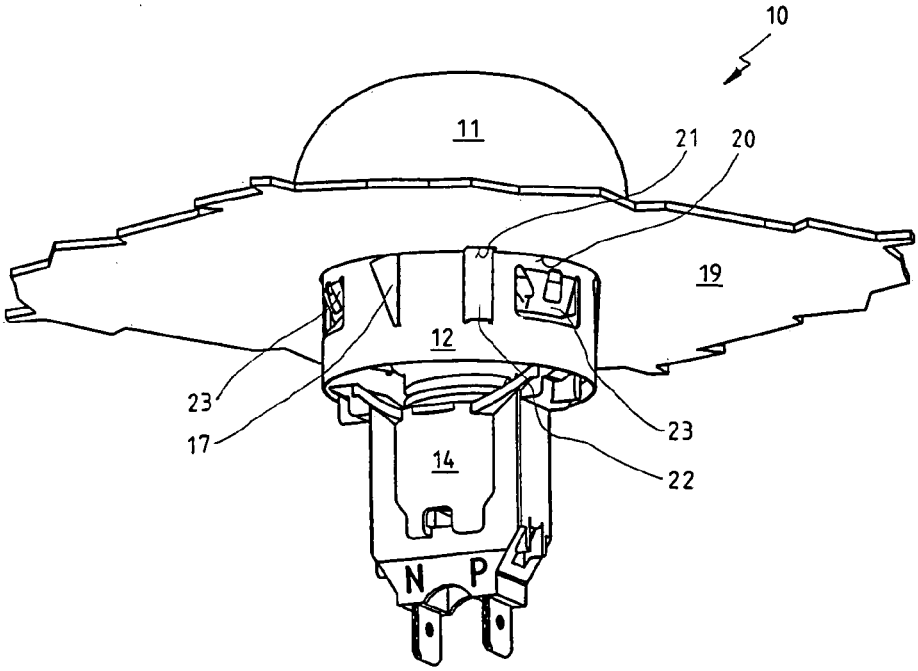
FIG. 2 is a perspective view from below of the installed light.

As seen in FIG. 1 an electric oven light 10 according to the invention basically comprises four parts, namely, a lens 11 having a stop surface 44, a housing 12 made of stainless steel or surface-treated steel sheet, a bulb 13 used as light source, and a bulb socket 14 into which the bulb 13 is inserted. The bulb socket 14 has connection contacts 15.

The housing 12 has an outwardly turned end flange or is rim 16, locking elements 17, and locking members 18 for movably mounting the lens 11, and is essentially a cylindrical sleeve centered on an axis A. As shown in FIGS. 1 and 2, the locking members 18 are spring tongues 23 projecting inward in the housing 12.

FIG. 2 shows the electric light 10 in an installed state. A section of the appliance, for example the side wall of an oven, is shown at 19. To receive the oven light 10 the wall 19 has an essentially circular hole 20 with an inwardly open positioning notch 21. The oven light 10 together with its housing 12 is inserted into the hole 20, with a positioning ridge 22 engaging in the positioning notch 21 and securing the housing 12 in the hole 20 against rotation about the axis A. The housing 12 rests, in a manner not illustrated, against the appliance wall 19 with the lower side of the housing flange 16 facing toward the socket 14 and bearing axially on the outer face of the wall 19. The locking elements 17 engage under or behind the appliance wall 19 and anchor the housing 12 in the hole 20 against axial movement. The socket 14 is itself permanently mounted, in a manner known per se, on the housing 12 by suitable fasteners.

Figure 3:
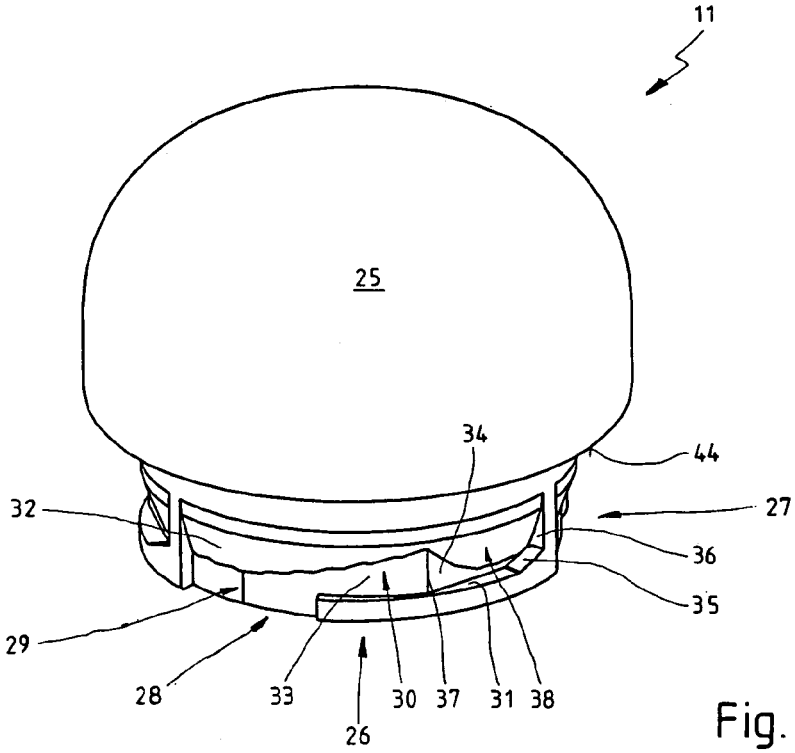
FIG. 3 is a perspective view from above of the lens.

FIG. 3 shows the lens 11 in detail. In the broadest sense, the lens 11 essentially comprises a cup-like glass dome 25 having an opening 26 that is defined by a cylindrical collar 27 centered also on the axis A when the lens 11 is installed in the housing 12. The lens 11 forms a stop surface or shoulder 44 in the transition region between the glass dome 25 and the collar 27. The collar 27 has on its outer surface a plurality of essentially L-shaped radially outwardly open grooves 28 each having an axially extending and open leg 29 and a circumferentially or angularly extending leg 30. The angularly extending groove leg 30 is defined between an axially outwardly directed outer flank 31 and an axially inwardly directed inner flank 32 lying between the respective outer flank 31 and the open side of the collar.

Figure 9:
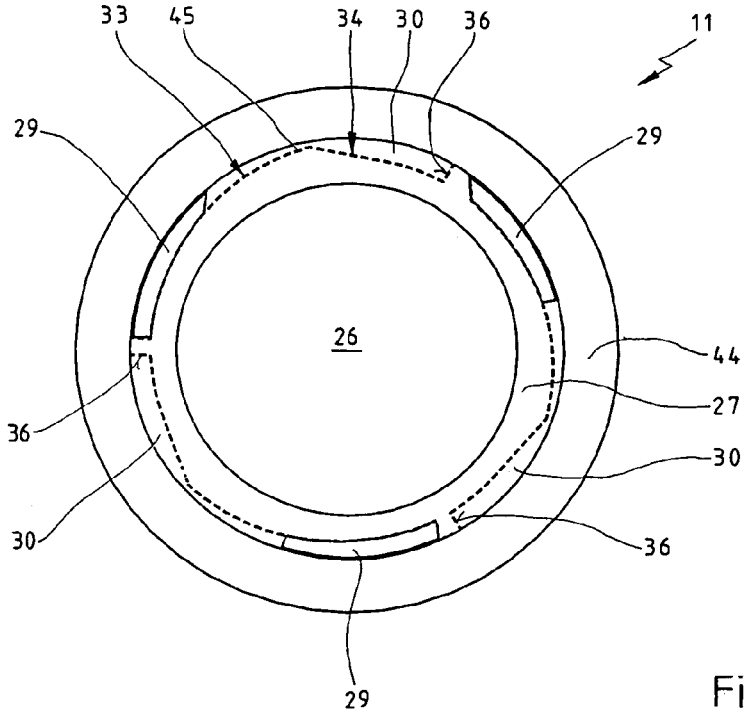
FIG. 9 is a bottom view like FIG. 8 but illustrating the camming action according to the invention.

The floor of the angularly extending groove leg 30 lying between the flanks 31 and 32 forms a radial cam face 45 (see FIG. 9, for example). The floor 33 slopes outward from adjacent the axial groove leg 29 toward the outer surface of the collar 27. The adjacent surface region 34 slopes inward to the floor level of the angularly extending groove leg 30 and provides protection from reverse rotation, that is unscrewing.

In the end of the angularly extending groove leg 30 remote from the axial groove leg 29, the outer flank 31 forms a stop bevel 35 that extends obliquely toward the dome 25. Adjoining the stop bevel 35 is a stop 36 for the corresponding spring tongue 23 that defines the end of the angularly extending groove leg 30 and the screw-in path of the lens 11 in the housing 12. The angularly extending groove leg 30 between the highest elevation 37 of the radial cam 45 and the stop 36 forms a bearing region 38 for the associated spring tongue 23 of the housing 12.

In the illustrated embodiment, the inner flanks 32 of the grooves 28 extend frustoconically inward to the floor 33 of the angularly extending groove leg 30. These inner flanks 32 are used solely to increase the stability of the collar 27 by virtue of the greater wall thickness in this region.

FIGS. 4 through 6 show the lens 11 together with its dome 25 and collar 27 in a partial view. Only one spring tongue 23 of the housing 12 is illustrated, with an angular width B that is somewhat less than the angular width of the axial groove leg 29. FIGS. 4 through 6 show how as the lens 11 is rotated (arrow X) relative to the spring tongue 23, the spring tongue 23 moves angularly along the leg 39 until the lens 11 is solidly secured in the housing 12.

The lens 11 is first oriented, in a manner not illustrated, with its axial groove legs 29 axially aligned with the spring tongues 23, and is inserted into the housing 12 in an axial direction Z. The spring tongues 23 move axially through the axial groove legs 29 until they reaching the angularly extending groove leg 30.

In the present illustrated embodiment the spring tongue 23 has three edges 39, 40, and 41, of which a left edge 39 and a right edge 40 extend axially, and a lower free edge 41 extends circumferentially or angularly, that is in a plane perpendicular to the axis A.

The left edge 39 of the spring tongue 23 forms a latch tab 24 that is bent from the spring tongue 23 somewhat inward toward the axis A and that in the end position of the spring tongue 23 or of the lens 11 illustrated in FIG. 6 essentially contacts only the floor 33 of the angularly extending groove leg 30 in essentially point contact. This results in a significantly reduced contact surface between the spring tongue 23 and the lens 11, thereby also advantageously preventing the spring tongues 23 from cooking onto the lens 11.

In FIG. 5 the lens 11 is moved in the installation rotation direction X by approximately the peripheral width B of the spring tongue 23. The spring tongues 23 slide along the upwardly sloping surface region of the floor 33 of the radial cam 45 and are spread radially outward relative to the axis A. In addition each spring tongue 23 enters the region of the outer flank 31, so that the lower edge 41 of the spring tongue 23 oriented toward the socket 14 moves along the outer flank 31 with play, thus preventing the lens 11 from sliding out or being pulled axially out.

In FIG. 6 the lens 11 has once again been moved in the direction x by approximately the width B of the spring tongue 23, so that the spring tongue 23 is situated in the bearing region 38. The lens 11 is in its installed end position. From this description of the installation process it is evident that the angular length of the angularly extending groove leg 30 approximately corresponds to three times the width B of the spring tongue 23.

Figure 7:
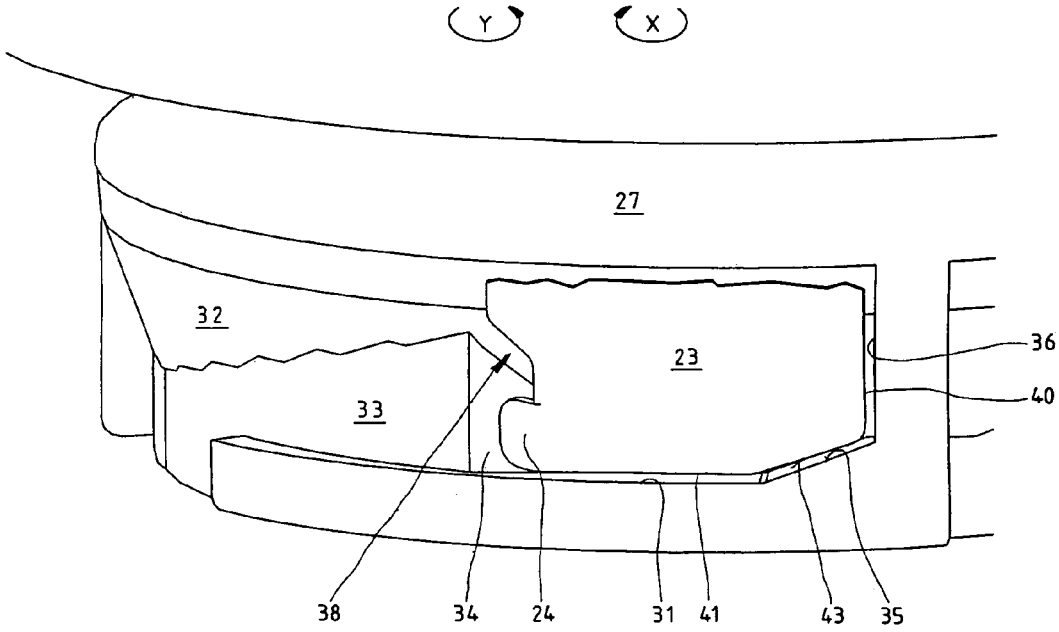
FIG. 7 is a large-scale side elevational view of the detail indicated at circle VII of FIG. 6.

FIG. 7 shows a detailed view of section VII in FIG. 6, i.e. a detailed view of the installed end position of the lens 11 in the housing 12. Here, as in FIGS. 4 through 6, only one spring tongue 23 for the housing 12 is illustrated. In the installed end position of the lens 11 this spring tongue 23 is situated in the bearing region 38, and as a result of the protection from reverse rotation provided by the surface region 34 is secured against becoming unscrewed, for example during transport. The angle of the angled surface region 34 in combination with the radial elastic forces from the spring tongue 23 essentially determines the unscrewing torque that is necessary to rotate the lens 11 in the disassembly direction Y and to remove the lens 11 from the housing 12. FIG. 7 also shows that the spring tongue 23 is supported on the surface region 34 of the angularly extending groove leg 30 essentially only by the lock catch 24.

A significant portion of the lower edge 41 situated in the circumferential direction of the collar is guided with play by the outer flank 31. The edge 41 is formed with a bevel 43 in a corner region adjacent the edge 40. The bevel 43 cooperates with the stop bevel 35 of the angularly extending groove leg 30, and is used primarily axial positioning the lens 11 in the housing 12 on the housing flange 16. The radial pretensioning of the spring tongue 23 and the steeply downwardly sloping surface region 34 produce an essentially automatic rotational motion of the lens 11 in the rotation direction x. The stop bevel 35 pushes against the bevel 43, resulting in automatic axial positioning of the lens 11. This ensures secure seating of the stop surface 44 of the lens 11 against the housing flange 16, despite any production tolerances of the lens 11.

In addition, a slight surface pressure between the housing flange 16 and the stop surface 44 may be achieved as a result of the tightening torque when the lens 11 is screwed in the installation rotation direction X, so that the resulting frictional forces between the housing flange 16 and the stop surface 44 additionally protect the lens 11 from becoming unscrewed. Tight seating of the lens 11 on the housing flange 16 also seals, for example, an oven chamber with respect to the outer appliance chamber and prevents the escape of vapors.

The problems of the housing flange 16 baking onto the stop surface 44, which are known to result from excessive tightening, are avoided by limiting the rotational motion in the installation rotation direction X. This is achieved by the stop 36 that borders the angularly extending groove leg 30 on the end side, and against which the edge 40 of the spring tongue 23 pushes according to calculated compensation for all possible axial production tolerances.

Limiting the rotational motion, such as by means of the spring tongues 23 according to the invention, prevents the occurrence of stresses in the housing 12 and possible deformation thereof as the result of an excessive tightening torque.

Figure 8:
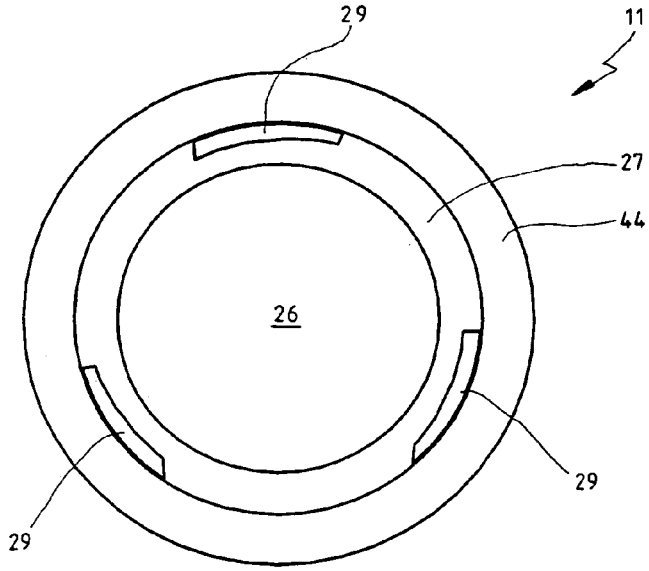
FIG. 8 is a bottom view of the lens.

FIG. 8 shows the lens in a view from below. The opening 26 is used to fit over the bulb 13 to protect it from contamination. When the lens 11 is installed, the illustrated stop surface 44 rests on the housing flange 16. In this view it is also easy to identify the axial groove legs 29 of the grooves 28, into which the locking projections 18 (not illustrated) designed as spring tongues 23 slide by means of an axial insertion motion in direction z.

FIG. 9 essentially corresponds to FIG. 8, with the location of the angularly extending groove leg 30 illustrated by dashed lines. The shape of the radial cam 45 formed by the floor of the angularly extending groove leg 30 with its gradually upwardly sloping surface region of the floor 33 and the adjoining steeply downward sloping surface region 34 may be easily identified.

Figure 10:
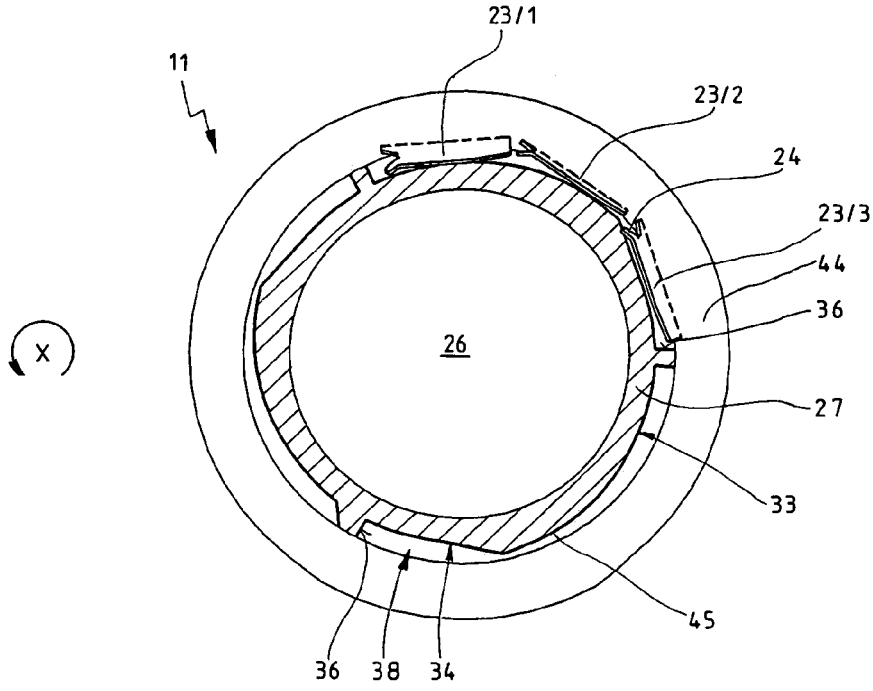
FIG. 10 is a sectional view like FIG. 9.

FIG. 10 likewise shows a view from below corresponding to FIGS. 8 and 9, the collar 27 being sectioned at approximately the level of the outer flank 31.

With reference to the spring tongue 23 illustrated in the three positions (23/1, 23/2, 23/3), together with FIGS. 4 through 6 the installation process may once again be followed. 23/1 corresponds to FIG. 4, 23/2 corresponds to FIG. 5, and 23/3 corresponds to FIG. 6, each in a view from below. It can be seen very clearly that when axially inserted, the spring tongue 23/1 contacts with a comparatively large portion of its surface area the floor 33 of the angularly extending groove leg 30. In the 23/2 position the spring tongue 23 is bent out and slides along the upwardly sloping surface region of the floor 33 of the radial cam 45. In the 23/3 position the spring tongue 23 is supported on the surface region 34 in a basically point contact by the latch tab 24 in the angularly extending groove leg 30, and the edge 41 rests against the outer flank 31, which is not illustrated on account of the section. It is therefore not possible for the spring tongues 23 in their installed end position in the bearing region 38 to be baked on as the result of high heat, which could prevent unscrewing of the lens 11.

The manner in which the individual features of the invention counteract the known problems for electric lights, in particular for ovens, can thus be readily seen with reference to the description of the drawing.

The basic structure of the collar 27 with its approximately L-shaped groove 28 on the outer periphery as a part of a bayonet mount and the design of the locking members 18 as spring tongues 23 avoid the problem known for screw-in lenses 11 of secure tightening and baking of the lens 11 onto the housing flange 16. In addition, by means of the spring tongues 23 the invention avoids the buildup of stresses in the housing 12, which may result in plastic deformation of the housing 12 and thus make it difficult to unscrew the lens 11.

By provision of a stop bevel 35 in a partial region of the angularly extending groove leg 30, the lens 11 may be securely pressed in annular line contact against the housing flange 16 in order to prevent the escape of vapors from inside the oven. When the lens 11 is screwed in, the stop 36 prevents an excessive tightening torque by virtue of the stop bevel 35 and bevel 43, thereby avoiding not only high stresses in the housing 12 but also excessive tightening of the seat and the resulting baking of the stop surface 44 onto the housing flange 16.

Finally, the special design of the spring tongues 23 with their latch tabs 24 results in a very small contact surface between the lens 11 and the spring tongues 23, so that here as well baking-on may be effectively avoided.

We claim:

1. In combination with an oven, an electrical oven light comprising:

a tubular sheet-metal housing fixed to the oven, centered generally on an axis and formed with a plurality of angularly spaced, radially inwardly projecting, and radially elastically deflectable spring tongues;

a socket in the housing adapted to hold a light bulb; and a cup-shaped glass lens having a dome formed with a generally cylindrical collar dimensioned to fit into the housing with the dome fitting over the light bulb in the socket, the collar being formed with a plurality of angularly spaced and radially outwardly open L-shaped grooves each fittable with a respective one of the housing tongues, each groove having an axially extending and open leg and an angularly extending leg, the angularly extending legs each having an outer flank and an inner flank between the respective outer flank and the dome.

2. An electrical light comprising:

a tubular sheet-metal housing centered generally on an axis and formed with a plurality of angularly spaced, radially inwardly projecting, and radially elastically deflectable spring tongues;

a socket in the housing adapted to hold a light bulb; and a cup-shaped class lens having a dome formed with a generally cylindrical collar dimensioned to fit into the housing with the dome fitting over the light bulb in the socket, the collar being formed with a plurality of angularly spaced and radially outwardly open L-shaped grooves each fittable with a respective one of the tongues, each groove having an axially extending and open lea and an angularly extending lea, the angularly extending leas each having an outer flank and an inner flank between the respective outer flank and the dome, the lens having an end face bearing axially in an installed position on an end face of the housing, the spring tongues each being axially slightly offset from the respective outer flank in the installed position.

3. An electrical light comprising:

a tubular sheet-metal housing centered generally on an axis and formed with a plurality of angularly spaced, radially inwardly projecting, and radially elastically deflectable spring tongues;

a socket in the housing adapted to hold a light bulb; and a cup-shaped class lens having a dome formed with a generally cylindrical collar dimensioned to fit into the housing with the dome fitting over the light bulb in the socket, the collar being formed with a plurality of angularly spaced and radially outwardly open L-shaped grooves each fittable with a respective one of the tongues, each groove having an axially extending and open leg and an angularly extending leg, the angularly extending leas each having an outer flank and an inner flank between the respective outer flank and the dome, each angularly extending leg having between the respective flanks a radially outwardly directed floor formed with a central raised cam region sloping radially outward in two opposite angular directions, whereby the spring tongues are deflected increasingly radially outward as they slide up over the respective raised cam regions.

4. The electrical light defined in claim 3 wherein each angularly extending leg terminates remote from the respective axially extending leg at a blind stop end and forms between the respective stop end and the respective raised cam region with a deep retaining region of an angular width greater than an angular width of the respective spring tongue.

5. The electrical light defined in claim 3 wherein each angularly extending leg terminates remote from the respective axially extending leg at a blind stop end, each angularly extending leg being formed at the respective stop end with an inclined bevel engageable with the spring tongue to cam same axially outward when it bears on the stop end.

6. The electrical light defined in claim 5 wherein the spring tongues have outer end edges each formed with a respective bevel complementary to and fittable with the bevel of the respective angularly extending leg.

7. The electrical light defined in claim 3 wherein each angularly extending leg terminates remote from the respective axially extending leg at a blind stop end.

8. The electrical light defined in claim 7 wherein the blind stop end is a surface extending generally in a plane including the axis.

9. An electrical light comprising:

a tubular sheet-metal housing centered generally on an axis and formed with a plurality of angularly spaced, radially inwardly projecting, and radially elastically deflectable spring tongues;

a socket in the housing adapted to hold a light bulb; and a cup-shaped glass lens having a dome formed with a generally cylindrical collar dimensioned to fit into the housing with the dome fitting over the light bulb in the socket, the collar being formed with a plurality of angularly spaced and radially outwardly open L-shaped grooves each fittable with a respective one of the tongues, each groove having an axially extending and open leg and an annularly extending leg, the angularly extending legs each having an outer flank and an inner flank between the respective outer flank and the dome, each spring tongue having a radially inwardly bent tab bearing on a floor of the respective groove.

10. The electrical light defined in claim 9 wherein each spring tongue has an axially outer end edge engageable with the outer flank of the angularly extending leg of the respective L-shaped groove.

11. An electrical light comprising:

a tubular sheet-metal housing centered generally on an axis and formed with a plurality of angularly spaced, radially inwardly projecting, and radially elastically deflectable spring tongues;

a socket in the housing adapted to hold a light bulb; and a cup-shaped class lens having a dome formed with a generally cylindrical collar dimensioned to fit into the housing with the dome fitting over the light bulb in the socket, the collar being formed with a plurality of angularly spaced and radially outwardly open L-shaped grooves each fittable with a respective one of the tongues, each groove having an axially extending and open lea and an angularly extending leg, the angularly extending leas each having an outer flank and an inner flank between the respective outer flank and the dome, the inner flank of each angularly extending groove being frustoconical, whereby the spring tongues are urged by the inner flanks toward the outer flanks so as to pull the lens into the housing.

12. An electrical light comprising:

a tubular sheet-metal housing centered generally on an axis and formed with a plurality of angularly spaced, radially inwardly projecting, and radially elastically deflectable spring tongues each having an outer edge turned formed with a bevel extending in a plane forming a small acute angle with the axis;

a socket in the housing adapted to hold a light bulb; and a cup-shaped glass lens having a dome formed with a generally cylindrical collar dimensioned to fit into the housing with the dome fitting over the light bulb in the socket, the collar being formed with a plurality of angularly spaced and radially outwardly open L-shaped grooves each fittable with a respective one of the tongues, each groove having an axially extending and open leg and an angularly extending leg, the angularly extending legs each having an outer flank and an inner flank between the respective outer flank and the dome, each outer flank being formed at an end remote from the respective axially extending leg with a bevel complementary to and fittable with the bevel of the respective tongue.

* * * * *